US009617094B2

(12) United States Patent
Suganuma

(10) Patent No.: US 9,617,094 B2
(45) Date of Patent: Apr. 11, 2017

(54) SHEET CONVEYOR AND IMAGE READER HAVING THE SAME

(71) Applicant: BROTHER KOGYO KABUSHIKI KAISHA, Nagoya-shi, Aichi-ken (JP)

(72) Inventor: Tsuyoshi Suganuma, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/195,230

(22) Filed: Jun. 28, 2016

(65) Prior Publication Data

US 2016/0304302 A1 Oct. 20, 2016

Related U.S. Application Data

(63) Continuation of application No. 14/583,294, filed on Dec. 26, 2014, now Pat. No. 9,388,001.

(30) Foreign Application Priority Data

Dec. 27, 2013 (JP) ..... 2013-270688

(51) Int. Cl.
*B65H 3/06* (2006.01)
*B65H 3/52* (2006.01)
*B65H 5/06* (2006.01)

(52) U.S. Cl.
CPC ..... *B65H 3/0684* (2013.01); *B65H 3/06* (2013.01); *B65H 3/0669* (2013.01);
(Continued)

(58) Field of Classification Search
CPC ..... B65H 2405/325; B65H 2405/313; B65H 2301/42324; B65H 2301/4234;
(Continued)

(56) References Cited

U.S. PATENT DOCUMENTS 5,163,668 A * 11/1992 Winship ..... B65H 3/5223 271/121
5,863,036 A * 1/1999 Tanaka ..... B65H 3/5223 271/10.11
5,938,188 A * 8/1999 Nagahara ..... B65H 3/5223 271/121
6,152,442 A 11/2000 Nishinohara et al.
8,333,373 B2 * 12/2012 Okuchi ..... B65H 3/5223 271/9.09
2002/0096819 A1 * 7/2002 Fukasawa ..... B65H 3/5223 271/121

(Continued)

FOREIGN PATENT DOCUMENTS

JP 11-100141 A 4/1999
JP 2011-073814 A 4/2011

*Primary Examiner* — Patrick Cicchino
(74) *Attorney, Agent, or Firm* — Merchant & Gould P.C.

(57) ABSTRACT

A sheet conveyor including a separation roller, a separation pad, an urging member urging the separation pad, and a feed roller unit disposed downstream relative to the separation roller in a conveyance direction, the feed roller unit including a first outer circumferential surface disposed on a first side in a width direction perpendicular to the conveyance direction, a second outer circumferential surface disposed on a second side opposite to the first side in the width direction, and a concave portion disposed between the first and second outer circumferential surfaces in the width direction, the concave portion being recessed inward in a radial direction of the first and second outer circumferential surfaces from the first and second outer circumferential surfaces, an urging member being disposed upstream relative to the concave portion in the conveyance direction and disposed between the first and second outer circumferential surfaces in the width direction.

12 Claims, 8 Drawing Sheets

(52) U.S. Cl.
CPC ..... *B65H 3/5223* (2013.01); *B65H 5/06* (2013.01); *B65H 5/062* (2013.01); *B65H 2301/4232* (2013.01); *B65H 2402/31* (2013.01); *B65H 2402/35* (2013.01); *B65H 2402/46* (2013.01); *B65H 2402/543* (2013.01); *B65H 2404/133* (2013.01); *B65H 2404/1313* (2013.01); *B65H 2404/1341* (2013.01); *B65H 2404/144* (2013.01); *B65H 2404/1531* (2013.01); *B65H 2404/6111* (2013.01); *B65H 2404/694* (2013.01); *B65H 2405/313* (2013.01); *B65H 2405/325* (2013.01); *B65H 2405/3321* (2013.01); *B65H 2801/39* (2013.01)

(58) Field of Classification Search
CPC B65H 2301/4232; B65H 3/0607; B65H 3/46; B65H 3/5223; B65H 3/5215; B65H 3/5207
USPC ..... 271/121
See application file for complete search history.

(56) References Cited

U.S. PATENT DOCUMENTS

| | | | | |
|---|---|---|---|---|
| 2003/0155702 | A1* | 8/2003 | Togashi | B65H 3/06 271/121 |
| 2006/0180987 | A1* | 8/2006 | Hattori | B65H 1/14 271/117 |
| 2006/0180989 | A1* | 8/2006 | Seike | B65H 3/5223 271/121 |
| 2011/0074087 | A1 | 3/2011 | Akimatsu | |
| 2012/0049438 | A1* | 3/2012 | Akimatsu | B65H 3/5223 271/121 |
| 2012/0228823 | A1* | 9/2012 | Miyakoshi | B65H 5/062 271/272 |
| 2013/0142561 | A1* | 6/2013 | Kim | B65H 3/0607 400/642 |
| 2013/0175140 | A1* | 7/2013 | Hiyama | B65H 3/063 198/604 |
| 2014/0049000 | A1* | 2/2014 | Kimura | B65H 3/5223 271/3.14 |

* cited by examiner

SHEET CONVEYOR AND IMAGE READER HAVING THE SAME

CROSS-REFERENCE TO RELATED APPLICATION

This application is a continuation of U.S. patent application Ser. No. 14/583,294, filed Dec. 26, 2014, and further claims priority under 35 U.S.C. §119 from Japanese Patent Application No. 2013-270688 filed on Dec. 27, 2013. The entire subject matter of bother applications are incorporated herein by reference.

BACKGROUND

Technical Field

The following description relates to aspects of a sheet conveyor and an image reader having the sheet separator.

Related Art

A sheet conveyor has been known that includes a separation roller, a separation pad, a first urging member, and a feed roller.

The separation roller is configured to rotate in contact with one or more sheets fed from upstream in a conveyance direction, and thereby convey the one or more sheets downstream in the conveyance direction. The separation pad is disposed to face the separation roller. The separation pad is configured to separate the one or more sheets on a sheet-by-sheet basis in cooperation with the separation roller. The first urging member is configured to urge the separation pad toward the separation roller. The feed roller is disposed downstream relative to the separation roller in the conveyance direction. The feed roller is configured to feed the one or more sheets separated by the separation roller and the separation pad, downstream in the conveyance direction.

The first urging member is disposed upstream relative to an outer circumferential surface of the feed roller in the conveyance direction.

SUMMARY

In the meantime, a sheet conveyor of this kind is highly required to be miniaturized. In this respect, nevertheless, in the known sheet conveyor, the first urging member needs to be sufficiently spaced apart from the feed roller in the conveyance direction, so as not to contact the outer circumferential surface of the feed roller. Therefore, it is difficult to downsize the known sheet conveyor in the conveyance direction.

Aspects of the present disclosure are advantageous to provide one or more improved techniques that make it possible to achieve miniaturization of a sheet conveyor in a conveyance direction.

According to aspects of the present disclosure, a sheet conveyor is provided, which includes a separation roller configured to rotate in contact with one or more sheets fed from upstream relative to the separation roller in a first direction, and convey the one or more sheets downstream in the first direction, a separation pad disposed to face the separation roller, the separation pad being configured to separate the one or more sheets on a sheet-by-sheet basis in cooperation with the separation roller, an urging member configured to urge the separation pad toward the separation roller, and a feed roller unit disposed downstream relative to the separation roller in the first direction, the feed roller being configured to feed the one or more sheets separated by the separation roller and the separation pad, downstream in the first direction, the feed roller unit including a first outer circumferential surface disposed at a first-side end portion of the feed roller unit in a second direction perpendicular to the first direction, a second outer circumferential surface disposed at a second-side end portion, opposite to the first-side end portion, of the feed roller unit in the second direction, the second outer circumferential surface having a diameter identical to a diameter of the first outer circumferential surface, and a concave portion formed between the first outer circumferential surface and the second outer circumferential surface in the second direction, the concave portion being recessed inward in a radial direction of the first outer circumferential surface and the second outer circumferential surface, from the first outer circumferential surface and the second outer circumferential surface, the urging member being disposed upstream relative to the concave portion in the first direction and disposed between the first outer circumferential surface and the second outer circumferential surface in the second direction.

According to aspects of the present disclosure, further provided is an image reader that includes a supply tray configured to support one or more sheets placed thereon, an image reading unit configured to read images of the one or more sheets fed from the supply tray, a separation roller disposed downstream relative to the supply tray in the first direction, the separation roller being configured to rotate in contact with the one or more sheets fed from the supply tray, and convey the one or more sheets downstream in a first direction, a separation pad disposed to face the separation roller, the separation pad being configured to separate the one or more sheets on a sheet-by-sheet basis in cooperation with the separation roller, an urging member configured to urge the separation pad toward the separation roller, and a feed roller unit disposed downstream relative to the separation roller in the first direction, the feed roller being configured to feed the one or more sheets separated by the separation roller and the separation pad, toward the image reading unit, the feed roller unit including a first outer circumferential surface disposed at a first-side end portion of the feed roller unit in a second direction perpendicular to the first direction, a second outer circumferential surface disposed at a second-side end portion, opposite to the first-side end portion, of the feed roller unit in the second direction, the second outer circumferential surface having a diameter identical to a diameter of the first outer circumferential surface, and a concave portion formed between the first outer circumferential surface and the second outer circumferential surface in the second direction, the concave portion being recessed inward in a radial direction of the first outer circumferential surface and the second outer circumferential surface, from the first outer circumferential surface and the second outer circumferential surface, the urging member being disposed upstream relative to the concave portion in the first direction and disposed between the first outer circumferential surface and the second outer circumferential surface in the second direction.

According to aspects of the present disclosure, further provided is sheet conveyor that includes a separation roller configured to rotate in contact with one or more sheets fed from upstream relative to the separation roller in a first direction, and convey the one or more sheets downstream in the first direction, a separation pad disposed to face the separation roller, the separation pad being configured to separate the one or more sheets on a sheet-by-sheet basis in cooperation with the separation roller, an urging member configured to urge the separation pad toward the separation roller, and a feed roller disposed downstream relative to the separation roller in the first direction, the feed roller being configured to feed the one or more sheets separated by the separation roller and the separation pad, downstream in the first direction, the feed roller including a first outer circumferential surface disposed at a first end portion of the feed roller in a second direction perpendicular to the first direction, a second outer circumferential surface disposed at a second end portion, opposite to the first end portion, of the feed roller in the second direction, the second outer circumferential surface having a diameter identical to a diameter of the first outer circumferential surface, and a concave portion disposed between the first outer circumferential surface and the second outer circumferential surface in the second direction, the concave portion having a diameter smaller than the diameter of the first outer circumferential surface and the second outer circumferential surface, the urging member being disposed upstream relative to the concave portion in the first direction and disposed between the first outer circumferential surface and the second outer circumferential surface in the second direction.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, illustrative embodiments according to aspects of the present disclosure will be described with reference to the accompanying drawings.

(First Illustrative Embodiment)

Figure 1:
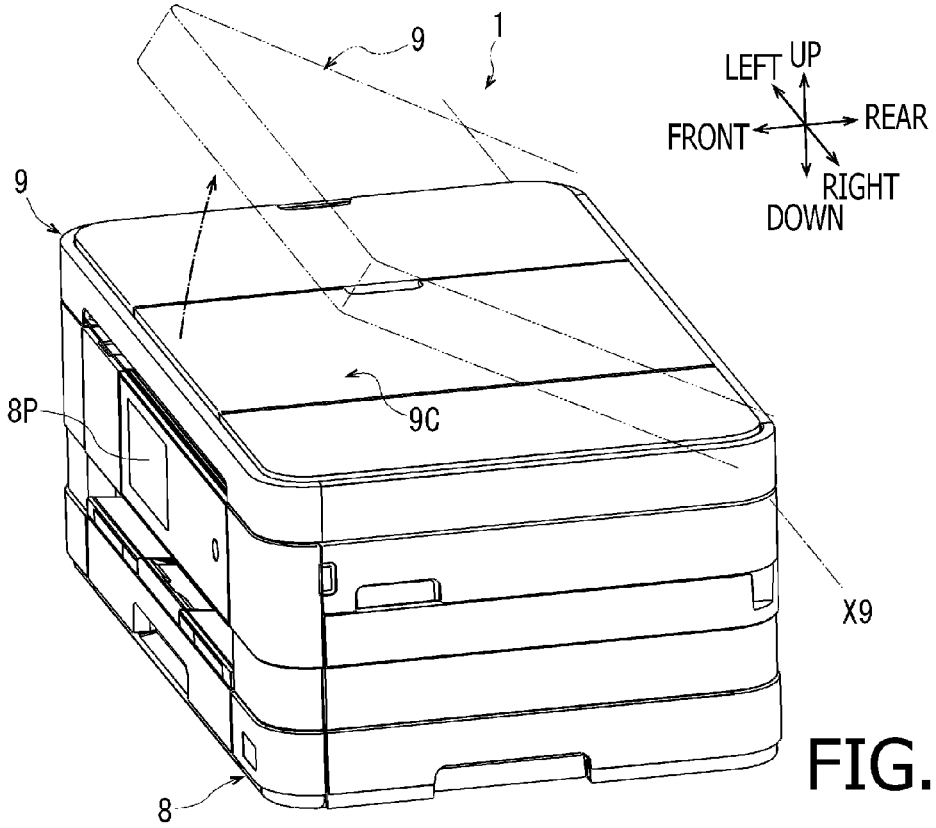
FIG. 1 is a perspective view of an image reader in a first illustrative embodiment according to one or more aspects of the present disclosure.

In an image reader 1 of a first illustrative embodiment, a front-to-rear direction, a left-to-right direction, and a vertical direction of the image reader 1 will be defined as shown in FIG. 1. For instance, a front side of the image reader 1 is defined as a side where an operation panel 8P is disposed. A left side of the image reader 1 is defined as a left-hand side in a front view (i.e., when a viewer faces the operation panel 8P). The same applies to the other drawings.

<Configuration>

Figure 2:
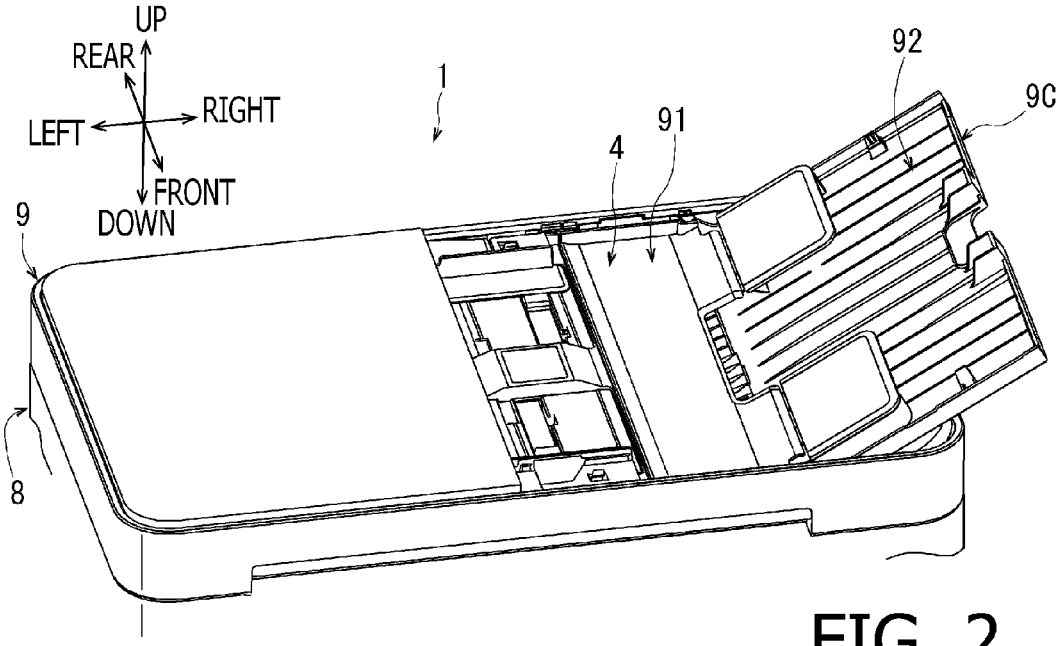
FIG. 2 is a perspective view showing a part of the image reader in the first illustrative embodiment according to one or more aspects of the present disclosure.
Figure 3:
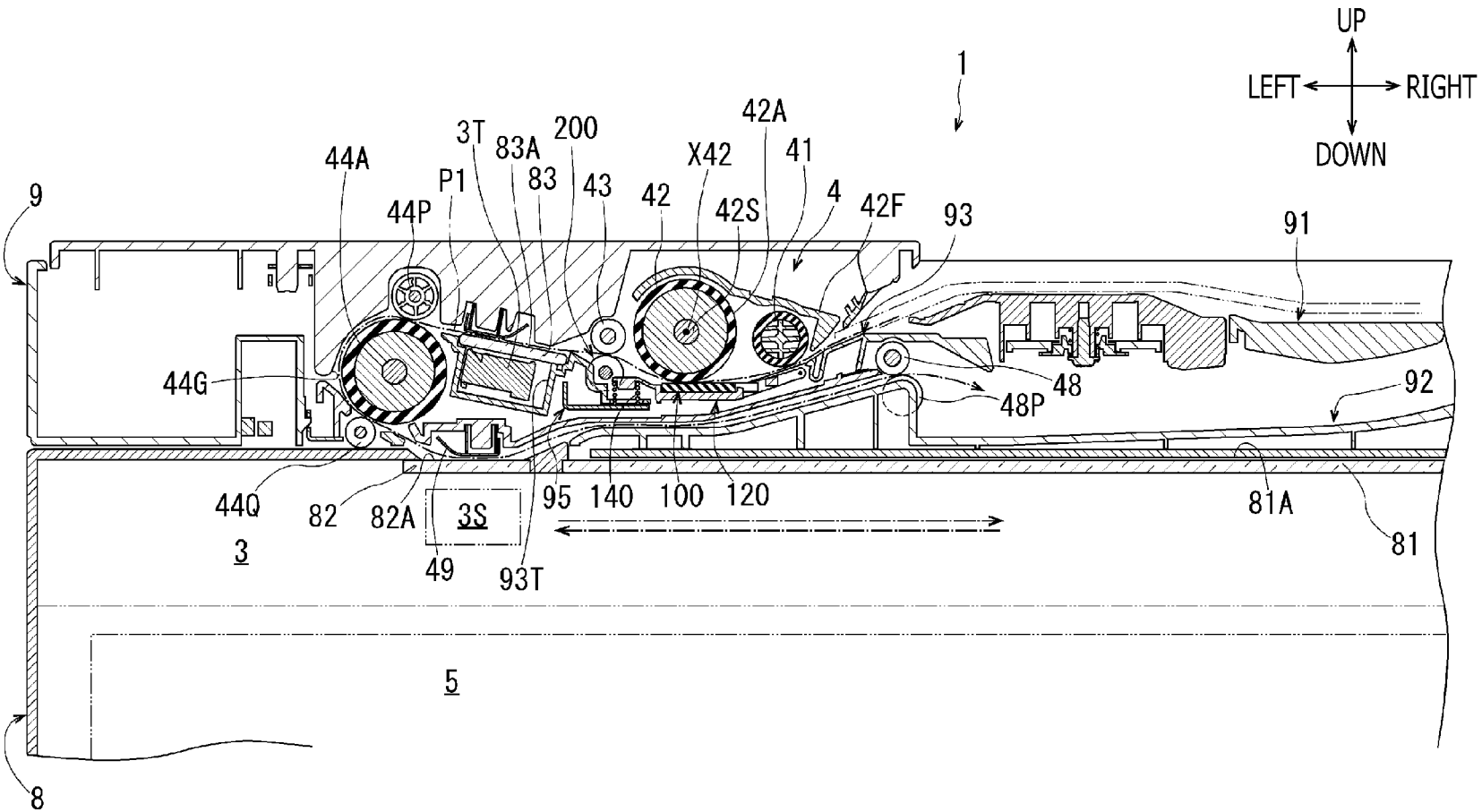
FIG. 3 is a cross-sectional front view showing a part of the image reader in the first illustrative embodiment according to one or more aspects of the present disclosure.

As shown in FIGS. 1 to 3, the image reader 1 includes a main body 8, an opening-closing member 9, a reading unit 3, a conveyor 4, and an image forming unit 5. The main body 8 is formed substantially in a flattened box shape. As shown in FIG. 1, on a front surface of the main body 8, an operation panel 8P (such as a touch panel) is disposed.

As shown in FIG. 3, the image forming unit 5 is disposed on a lower portion inside the main body 8. The image forming unit 5 is configured to perform image formation in an inkjet method or a laser method, although it is not shown in any drawings.

On an upper surface of the main body 8, a first platen glass 81 and a second platen glass 82 are disposed. An upper surface of the first platen glass 81 forms a document supporting surface 81A. The document supporting surface 81A is configured to support from beneath a document to be read, when the reading unit 3 reads an image of the document in a static state. The document to be read may include a paper, a transparency (an OHP sheet), and a book. The second platen glass 82 is disposed on a left side relative to the first platen glass 81. The second platen glass 82 is elongated to extend in the front-to-rear direction. An upper surface of the second platen glass 82 forms a reading surface 82A. The reading surface 82A is configured to guide one or more sheets from beneath when the reading unit 3 reads images of the one or more sheets being conveyed on a sheet-by-sheet basis by the conveyor 4.

As shown in FIG. 1, the opening-closing member 9 is supported by hinges (not shown) disposed at an upper end portion of a rear surface side of the main body 8, so as to be rotatable around an opening-closing axis X9 extending in the left-to-right direction. As indicated by a solid line in FIG. 1, when closed, the opening-closing member 9 covers the document supporting surface 81A from above. As indicated by an alternate long and two short dashes line in FIG. 1, the opening-closing member 9 swings around the opening-closing axis X9 such that a front end portion of the opening-closing member 9 moves toward an upper rear side. Thereby, the document supporting surface 81A is exposed. Thus, a user is allowed to put a document to be read onto the document supporting surface 81A.

As shown in FIG. 3, the reading unit 3 includes a reading sensor 3S, a scanning mechanism (not shown), and a reading sensor 3T. The reading sensor 3S is disposed below the document supporting surface 81A and the reading surface 82A, at an upper portion inside the main body 8. The scanning mechanism is configured to reciprocate the reading sensor 3S along the left-to-right direction inside the main body 8. As will be described later, the reading sensor 3T is disposed in a middle of a conveyance path P1 inside the opening-closing member 9. More specifically, the reading sensor 3T is disposed to face the conveyance path P1 across a below-mentioned third platen glass 83. A reading surface 83A of the third platen glass 83 is configured to guide a sheet from beneath when the reading sensor 3T reads an image of the sheet being conveyed by the conveyor 4. As the reading sensors 3S and 3T, known image sensors may be used such as contact image sensors (hereinafter referred to as CISs) or charge coupled devices (hereinafter referred to as CCDs).

When the reading unit 3 reads an image of a document supported on the document supporting surface 81A, the reading sensor 3S is moved, by the scanning mechanism (not shown), along the left-to-right direction between a position under a left end portion of the document supporting surface 81A and a position under a right end portion of the document supporting surface 81A. Further, when the reading unit 3 reads images of sheets SH being conveyed on a sheet-by-sheet basis by the conveyor 4, the reading sensor 3S is caused, by the scanning mechanism (not shown), to stop in a predetermined reading position under the reading surface 82A.

As shown in FIGS. 2 and 3, the conveyor 4 is disposed at the opening-closing member 9. The conveyor 4 includes a supply tray 91 and a discharge tray 92. The supply tray 91 and the discharge tray 92 are formed on a right side relative to the opening-closing member 9, when a cover 9C closed as shown in FIG. 1 is extended as shown in FIG. 2. The discharge tray 92 is disposed below the supply tray 91. The supply tray 91 is configured to support, from beneath, sheets to be conveyed by the conveyor 4. The discharge tray 92 is configured to support one or more sheets discharged by the conveyor 4 after images of the one or more sheets have been read by the reading sensors 3S and 3T.

As shown in FIG. 3, the conveyor 4 includes the conveyance path P1 defined as a space surrounded by guide surfaces, which extend to be able to contact one side and the other side of a sheet inside the opening-closing member 9. First, the conveyance path P1 includes a portion extending leftward from the supply tray 91 in a substantially horizontal direction. Next, the conveyance path P1 includes a portion U-turning downward. The downward U-turning portion is disposed downstream relative to the reading surface 83A in the conveyance direction. Subsequently, the conveyance path P1 includes a portion extending short toward the right along the reading surface 82A. Finally, the conveyance path P1 includes an obliquely-ascending portion that is slanted upward (relative to a horizontal plane) in a rightward direction and leads to the discharge tray 92.

On the upper portion of the conveyance path P1 that extends in a substantially horizontal direction, the conveyance direction of the sheets conveyed by the conveyor 4 is the leftward direction. On the downward U-turning portion of the conveyance path P1, the conveyance direction of the sheets changes from the leftward direction to the rightward direction. On the lower portion of the conveyance path P1 that passes over the reading surface 82A and leads to the discharge tray 92, the conveyance direction of the sheets is the rightward direction.

As shown in FIGS. 3 to 9, the conveyor 4 includes a chute member 93, a pickup roller 41, a separation roller 42, a separation pad 100, a supporter 120, a reinforcing member 95, and a first urging member 140.

As shown in FIGS. 3 to 5, and 7, the chute member 93 is a resin molded body formed substantially in a flat plate shape. The chute member 93 is connected with a left end portion of the supply tray 91, and further extends leftward therefrom. An upper surface of the chute member 93 is a guide surface 93A. The guide surface 93A extends in a substantially horizontal direction, and is configured to contact, from beneath, the sheets fed from the supply tray 91. Namely, the guide surface 93A defines a lower part of the substantially-horizontal upper portion of the conveyance path P1. In the first illustrative embodiment, a direction substantially perpendicular to the guide surface 93A is the vertical direction. Further, a left end portion of the guide surface 93A is slanted downward in a direction toward the pickup roller 41 from the supply tray 91.

Figure 5:
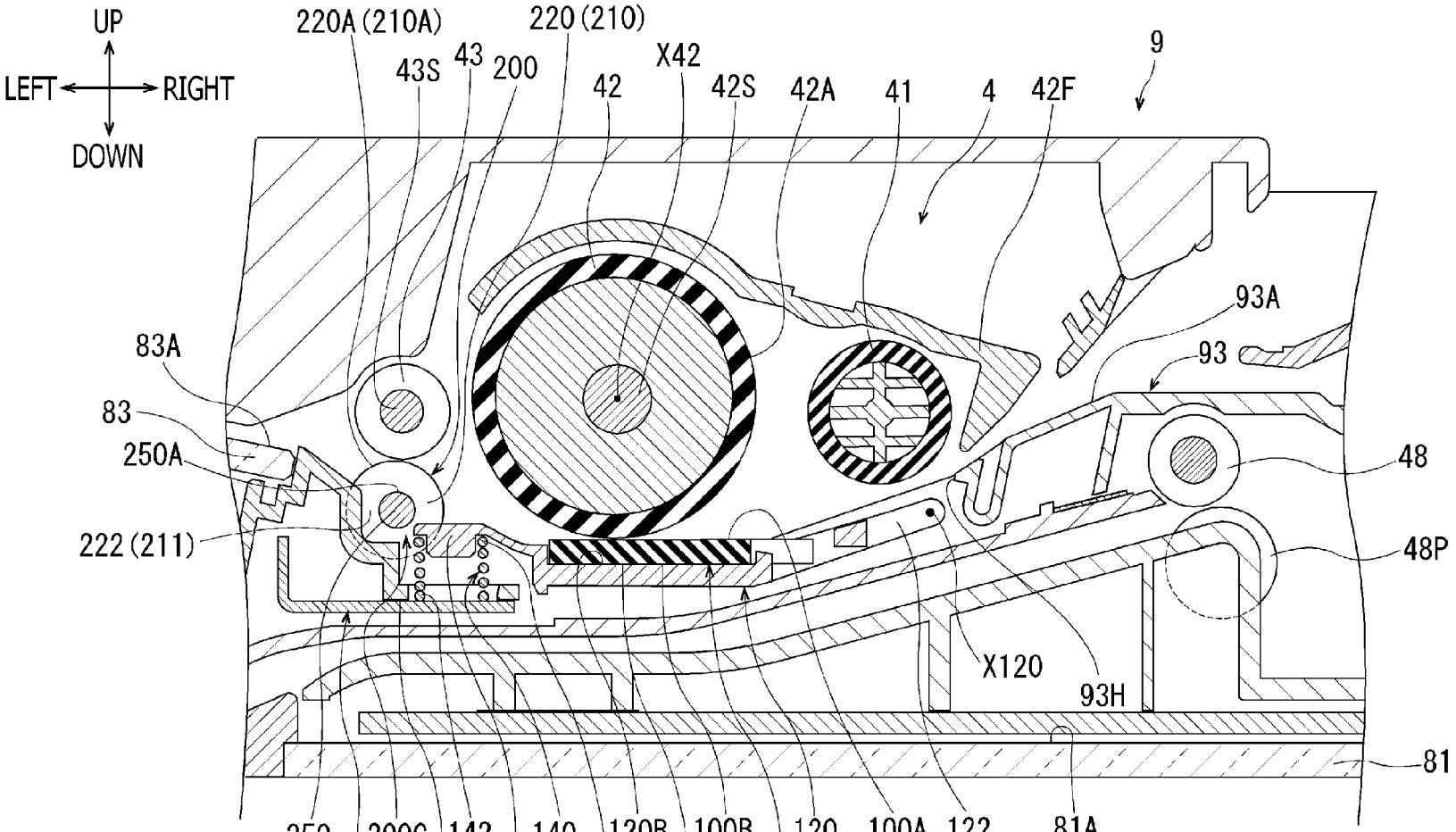
FIG. 5 is a cross-sectional front view taken along an A-A line shown in FIG. 4, in the first illustrative embodiment according to one or more aspects of the present disclosure.

As shown in FIGS. 3 and 5, the pickup roller 41 and the separation roller 42 are disposed to face the chute member 93 from above. The separation roller 42 is attached to a drive shaft 42S having an axis X42 as a central axis extending in the front-to-rear direction. The separation roller 42 is configured to rotate around the axis X42, integrally with the drive shaft 42S. The separation roller 42 has an outer circumferential surface 42A that is a cylindrical circumference with the axis X42 (the drive shaft 42S) as a central axis. The outer circumferential surface 42A is formed as a surface of an elastic rubber layer formed on an outer circumferential side of the separation roller 42.

The separation roller 42 is configured to rotate while bringing the outer circumferential surface 42A into contact with a sheet fed from the supply tray 91 (i.e., from upstream relative to the separation roller 42 in the conveyance direction), and convey the sheet leftward (i.e., downstream in the conveyance direction) along the substantially-horizontal upper portion of the conveyance path P1.

In the substantially-horizontal upper portion of the conveyance path P1, the direction leftward from the right, which is the conveyance direction of the sheet, intersects perpendicularly with the axis X42 extending in the front-to-rear direction. In the first illustrative embodiment, a width direction perpendicular to the conveyance direction is the front-to-rear direction. One side in the width direction is the front side of the image reader 1. The other side in the width direction is the rear side of the image reader 1.

By the drive shaft 42S, a holder 42F is swingably supported. The holder 42F protrudes rightward from the drive shaft 42S. The pickup roller 41 is rotatably supported by a right portion of the holder 42F. The holder 42F is provided with a transmission gear group (not shown) configured to transmit a rotational driving force from the drive shaft 42S to the pickup roller 41.

The pickup roller 41 rotates around an axis parallel to the axis X42 of the separation roller 42, provides a conveyance force to a top one of the sheets supported on the supply tray 91, and conveys the top sheet toward the separation roller 42.

As shown in FIGS. 3 to 6, the separation pad 100 is disposed in such a position, on a side close to the chute member 93, as to face the separation roller 42 from beneath. The separation pad 100 is a plate-shaped member made of soft material such as rubber and elastomer.

Figure 6:
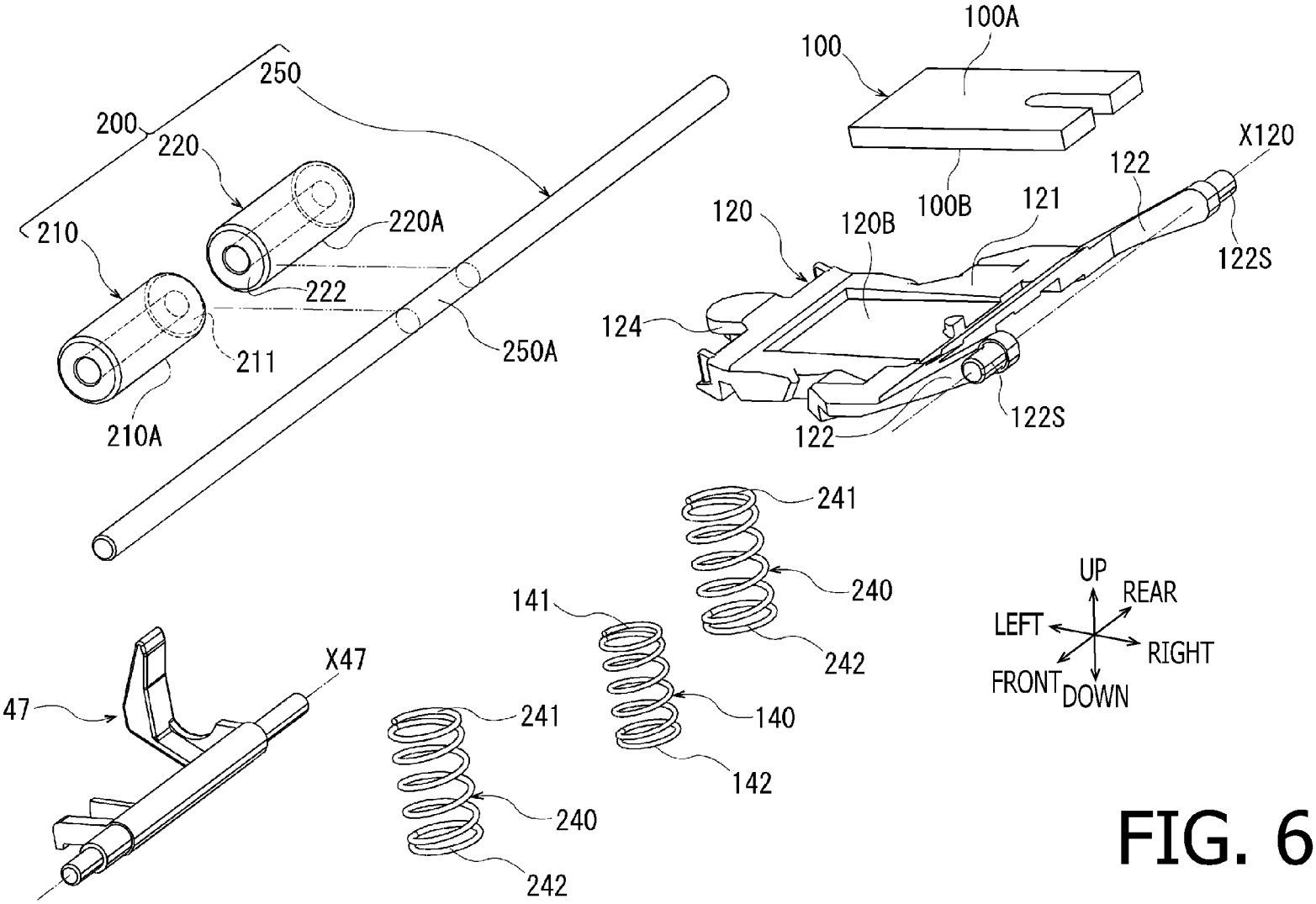
FIG. 6 is an exploded perspective view showing the separation pad, the first urging member, the feed roller unit, and the second urging member of the image reader in the first illustrative embodiment according to one or more aspects of the present disclosure.

As shown in FIGS. 5 to 6, the separation pad 100 has a separation surface 100A and a bonded surface 100B. The separation surface 100A is an upward-facing surface opposed to the outer circumferential surface 42A of the separation roller 42. The bonded surface 100B is a downward-facing surface.

Figure 4:
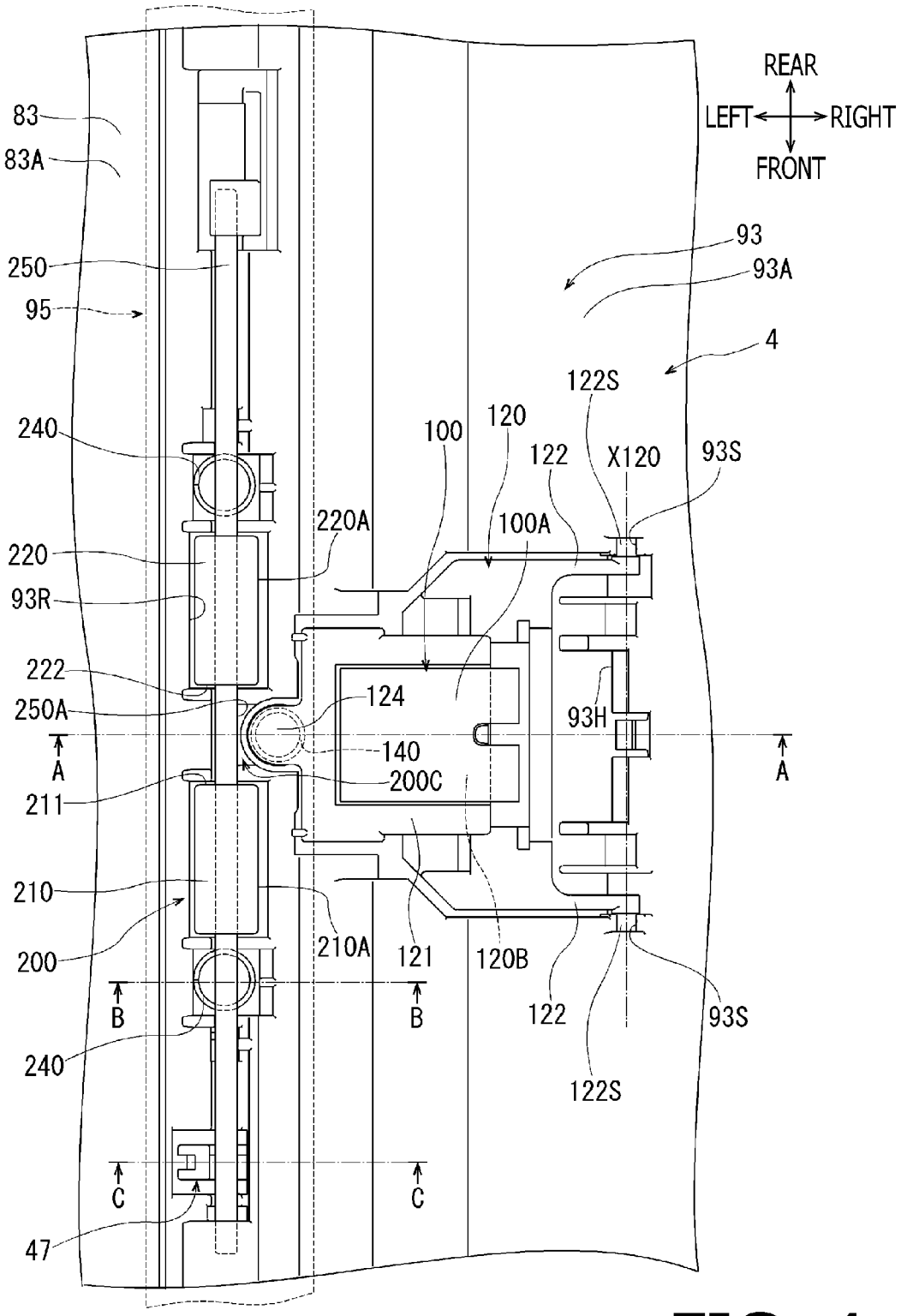
FIG. 4 is a plane view showing a chute member, a separation pad, a first urging member, a feed roller unit, and a second urging member of the image reader in the first illustrative embodiment according to one or more aspects of the present disclosure.
Figure 7:
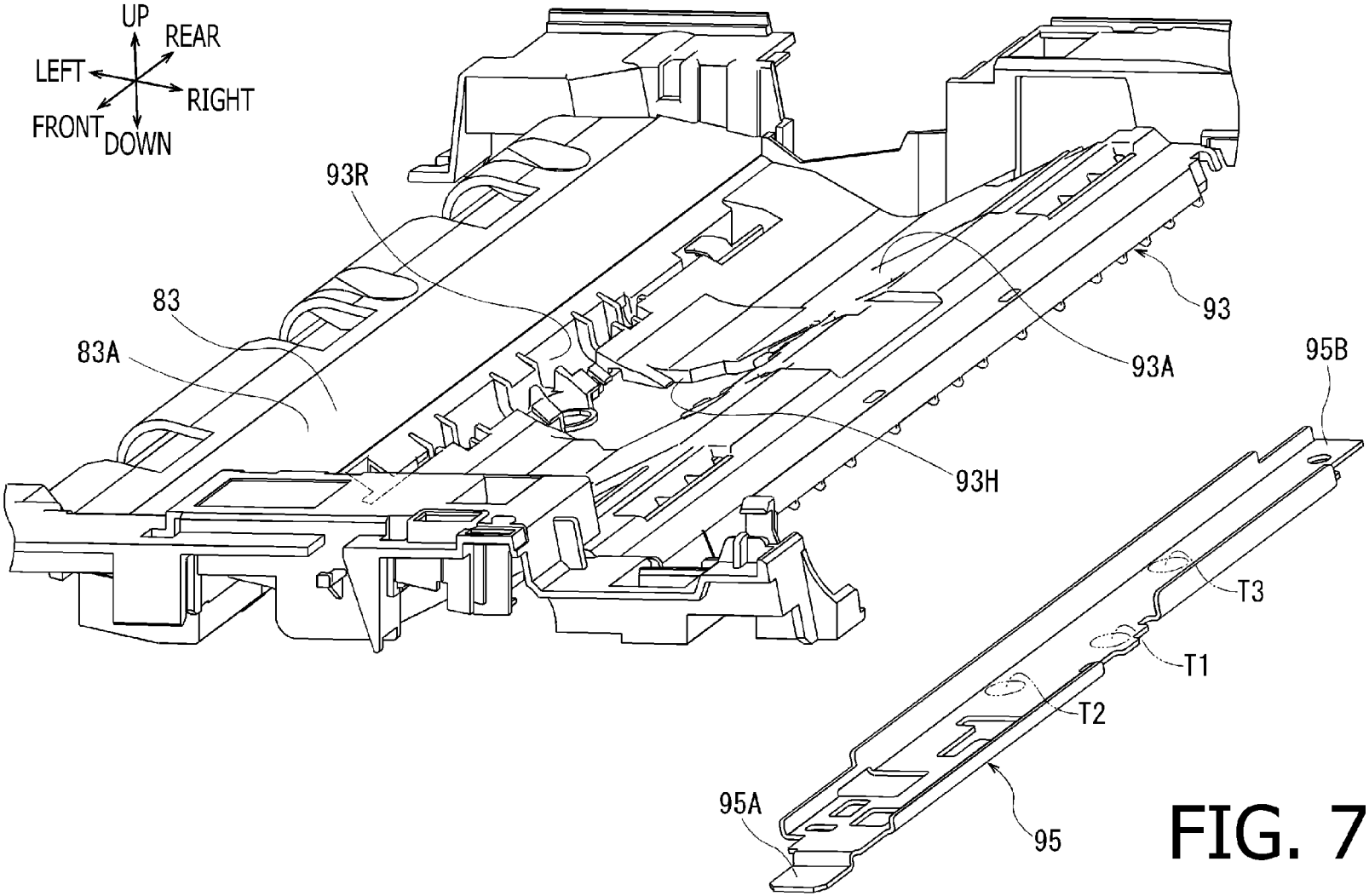
FIG. 7 is an exploded perspective view showing the chute member and a reinforcing member of the image reader in the first illustrative embodiment according to one or more aspects of the present disclosure.

As shown in FIGS. 4, 5, and 7, the chute member 93 has an opening 93H. The opening 93H is formed by cutting, out of the chute member 93, a portion positioned on a lower side relative to the separation roller 42. As shown in FIG. 4, at a right front corner portion and a right rear corner portion of the opening 93H, two bearings 93S (i.e., a front bearing 93S and a rear bearing 93S) are disposed in a recessed manner, respectively.

As shown in FIGS. 4 to 6, the supporter 120 is a resin molded body that includes a base 121, and two protrusions 122 (i.e., a front protrusion 122 and a rear protrusion 122).

The base 121 is formed substantially in a rectangular plate shape. On an upper surface of the base 121, a supporting surface 120B is formed. The supporting surface 120B is a bottom surface of a concave portion shallowly recessed from an uppermost surface of the base 121. At a left side of the base 121, a spring receiver 124 is formed. The spring receiver 124 is a small piece that protrudes leftward from a left end portion of the base 121. On a lower surface of the spring receiver 124, a boss is formed to protrude downward.

The front protrusion 122 protrudes rightward from a front right corner portion of the base 121. The rear protrusion 122 protrudes rightward from a rear right corner portion of the base 121. There are two shaft portions 122S (i.e., a front shaft portion 122S and a rear shaft portion 122S) formed at respective right end portions of the protrusions 122. Each shaft portion 122S is a cylindrical shaft body with a swing axis X120 as a central axis. The swing axis X120 extends in the front-to-rear direction. The swing axis X120 is disposed on a right side relative to the outer circumferential surface 42A of the separation roller 42. In other words, the swing axis X120 is positioned upstream relative to the separation roller 42 in the conveyance direction. The front shaft portion 122S and the rear shaft portion 122S protrude in such directions as to become farther away from each other, respectively.

As shown in FIG. 4, when each shaft portion 122S of the supporter 120 is fitted into a corresponding one of the bearings 93S of the chute member 93, the supporter 120 is supported by the chute member 93 to be swingable around the swing axis X120.

As shown in FIG. 5, the supporting surface 120B of the supporter 120 is bonded with the bonded surface 100B of the separation pad 100 via a double-sided adhesive tape or adhesive material. Thereby, the supporter 120 supports the separation pad 100.

Figure 8:
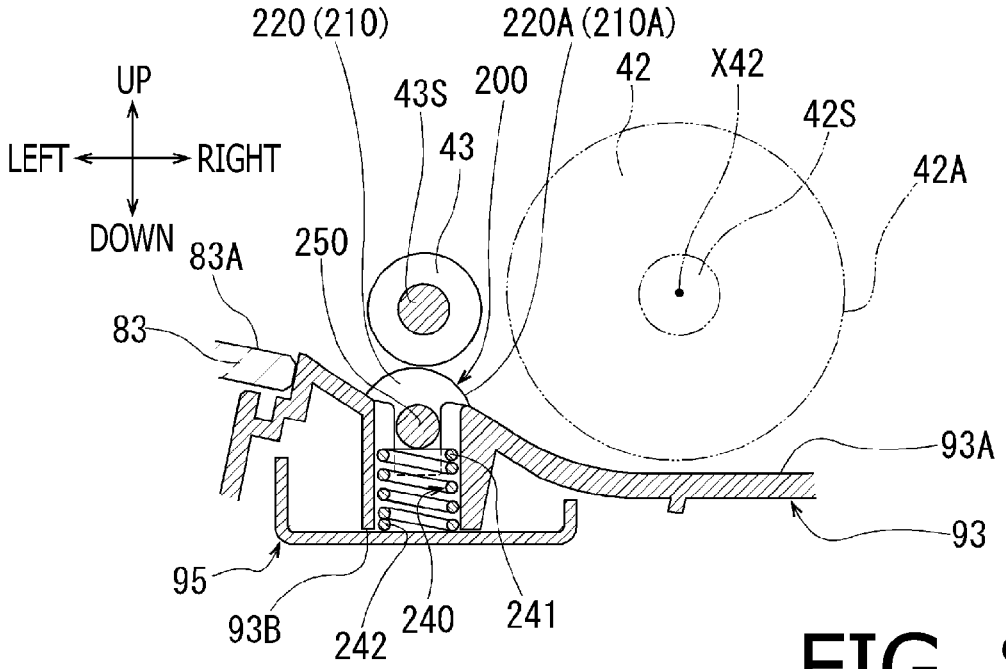
FIG. 8 is a cross-sectional front view taken along a B-B line shown in FIG. 4, in the first illustrative embodiment according to one or more aspects of the present disclosure.

As shown in FIG. 7, the reinforcing member 95 is a metal member formed substantially in a flat plate shape that is elongated in the front-to-rear direction. The reinforcing member 95 is formed, for instance, by punching and bending a thin steel sheet. As shown in FIGS. 5 and 8, the reinforcing member 95 is disposed adjacent to a downward-facing surface 93B of the chute member 93 that is opposite to the guide surface 93A of the chute member 93.

In a plane view as shown in FIG. 4, the reinforcing member 95 is disposed on a far side relative to the chute member 93 in a direction perpendicular to a paper surface of FIG. 4. In the plane view, a right end portion of the reinforcing member 95 is disposed adjacent to a left end portion of the opening 93H of the chute member 93. On a left side relative to the opening 93H of the chute member 93, a feed-roller accommodating section 93R is formed. The feed-roller accommodating section 93R is disposed above the reinforcing member 95. The feed-roller accommodating section 93R is recessed downward from the guide surface 93A, and extends in the front-to-rear direction. A front end portion 95A and a rear end portion 95B of the reinforcing member 95 shown in FIG. 7 are engaged with a base member (not shown) disposed below the chute member 93. Thereby, the reinforcing member 95 reinforces the chute member 93 from beneath.

As shown in FIGS. 4 to 6, the first urging member 140 is a compression coil spring. As shown in FIG. 5, an upper end portion 141 of the first urging member 140 engages with the spring receiver 124 of the supporter 120. Namely, the upper end portion 141 is connected with a portion of the supporter 120 that is positioned downstream relative to the separation pad 100 in the conveyance direction. A lower end portion 142, opposite to the upper end portion 141, of the first urging member 140 is in direct contact with the reinforcing member 95. FIG. 7 shows a position T1 where the lower end portion 142 of the first urging member 140 directly contacts the reinforcing member 95.

The first urging member 140 is configured to urge the separation pad 100 via the supporter 120 in such a direction that the separation surface 100A of the separation pad 100 approaches the outer circumferential surface 42A of the separation roller 42.

As shown in FIG. 4, in the plane view, the first urging member 140 is spaced apart leftward from the separation pad 100. Namely, when viewed in the vertical direction, the first urging member 140 is disposed in such a position as not to overlap the separation pad 100.

When a plurality of mutually overlapping sheets are fed to the separation roller 42 from the pickup roller 41, the separation pad 100 configured as above separates the sheets on a sheet-by-sheet basis in cooperation with the separation roller 42.

As shown in FIGS. 3 to 6, the conveyor 4 includes a feed roller unit 200, two second urging members 240 (i.e., a front-side second urging member 240 and a rear-side second urging member 240), and driving feed rollers 43.

As shown in FIG. 4, the feed roller unit 200 is accommodated in the feed-roller accommodating section 93R. As shown in FIG. 5, the feed roller unit 200 is disposed on a left side relative to the outer circumferential surface 42A of the separation roller 42. In other words, the feed roller unit 200 is disposed downstream relative to the separation roller 42 in the conveyance direction.

As shown in FIGS. 4 to 6, the feed roller unit 200 includes a rotational shaft 250, a first feed roller 210, and a second feed roller 220.

Figure 9:
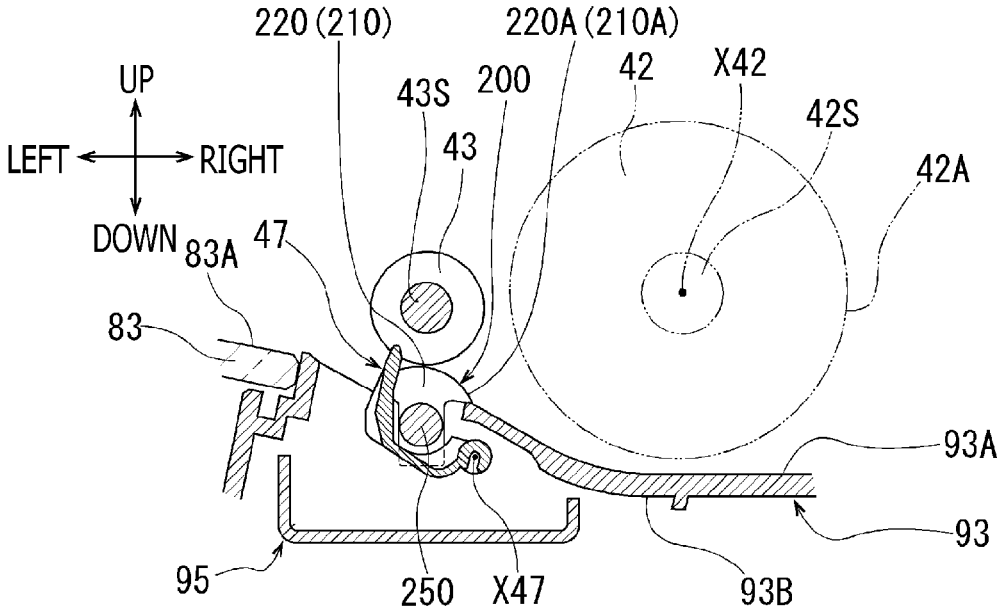
FIG. 9 is a cross-sectional front view taken along a C-C line shown in FIG. 4, in the first illustrative embodiment according to one or more aspects of the present disclosure.

The rotational shaft 250 is a cylindrical shaft body extending in the front-to-rear direction. As shown in FIGS. 4, 8, and 9, the rotational shaft 250 is supported by the feed-roller accommodating section 93R to be movable in the vertical direction, e.g., by being held by ribs that are formed to protrude in the feed-roller accommodating section 93R.

As shown in FIGS. 4 to 6, the first feed roller 210 and the second feed roller 220 are cylindrical bodies that have the same outer diameter and the same inner diameter. The inner diameter of the first feed roller 210 and the second feed roller 220 is slightly larger than an outer diameter of the rotational shaft 250. A front portion of the rotational shaft 250 is inserted through the first feed roller 210. A rear portion of the rotational shaft 250 is inserted through the second feed roller 220. Thereby, the first feed roller 210 and the second feed roller 220 are rotatably held by the rotational shaft 250. Upper portions of outer circumferential surfaces of the first feed roller 210 and the second feed roller 220 are exposed out of the feed-roller accommodating section 93R.

As shown in FIGS. 4, 6, and 8, the second urging members 240 are compression coil springs of the same configuration. As shown in FIG. 4, the front-side second urging member 240 is accommodated in the feed-roller accommodating section 93R, in front of the first feed roller 210. The rear-side second urging member 240 is accommodated in the feed-roller accommodating section 93R, behind the second feed roller 210.

As shown in FIG. 8, an upper end section 241 of the front-side second urging member 240 contacts the rotational shaft 250 from beneath. A lower end section 242 of the front-side second urging member 240 directly contacts the reinforcing member 95. It is noted that the lower end section 242 is a lower end portion, opposite to the upper end section 241, of the front-side second urging member 240. FIG. 7 shows a position T2 where the lower end section 242 of the front-side second urging member 240 directly contacts the reinforcing member 95.

An upper end section 241 of the rear-side second urging member 240 contacts the rotational shaft 250 from beneath, although it is not shown in any drawings since the rear-side second urging member 240 is configured in the same manner as the front-side second urging member 240. Further, a lower end section 242, opposite to the upper end section 241, of the rear-side second urging member 240 directly contacts the reinforcing member 95. FIG. 7 shows a position T3 where the lower end section 242 of the rear-side second urging member 240 directly contacts the reinforcing member 95.

Each second urging member 240 is configured to urge the first feed roller 210 and the second feed roller 220 upward via the rotational shaft 250.

Although the following features are not shown in any drawings, the driving feed rollers 43 contain a front-side driving feed roller 43 and a rear-side driving feed roller 43 that correspond to the first feed roller 210 and the second feed roller 220, respectively. As shown in FIG. 5, the driving feed rollers 43 are fixedly attached to the drive shaft 43S extending in the front-to-rear direction. The driving feed rollers 43 are configured to rotate integrally with the drive shaft 43S. The driving feed rollers 43 are disposed above the first feed roller 210 and the second feed roller 220. The first feed roller 210 and the second feed roller 220 are urged by the second urging members 240 and pressed against the driving feed rollers 43, respectively. The first feed roller 210 and the second feed roller 220 are driven to rotate in accordance with rotation of the driving feed rollers 43.

The first feed roller 210 and the second feed roller 220 nip therebetween each of the sheets separated on a sheet-by-sheet basis by the separation roller 42 and the separation pad 100. Then, the first feed roller 210 and the second feed roller 220 convey each of the separated sheets downstream in the conveyance direction.

In other words, the aforementioned configuration of the feed roller unit 200 may be restated as follows. As shown in FIGS. 4 and 5, the feed roller unit 200 includes a first outer circumferential surface 210A, a second outer circumferential surface 220A, and a concave portion 200C. The first outer circumferential surface 210A is a cylindrical surface formed by as an outer circumferential surface of the first feed roller 210 disposed at a front portion of the rotational shaft 250. The second outer circumferential surface 220A is a cylindrical surface formed by an outer circumferential surface of the second feed roller 220 disposed at a rear portion of the rotational shaft 250. The first outer circumferential surface 210A and the second outer circumferential surface 220A have the same diameter. The concave portion 200C is formed by an outer circumferential surface 250A, a first end surface 211, and a second end surface 222. The outer circumferential surface 250A is a partial outer circumferential surface of the rotational shaft 250 that is positioned between the first feed roller 210 and the second feed roller 220. The first end surface 211 is a rear end surface of the first feed roller 210. The second end surface 222 is a front end surface of the second feed roller 220. Namely, the concave portion 200C is disposed between the first outer circumferential surface 210A and the second outer circumferential surface 220A. The concave portion 200C is recessed inward in a radial direction from the first outer circumferential surface 210A and the second outer circumferential surface 220A.

The following description will provide a specific explanation about relative positional relationships between the first urging member 140 and elements included in the feed roller unit 200 (such as the first outer circumferential surface 210A, the second outer circumferential surface 220A, and the concave portion 200C). As shown in FIG. 4, the first urging member 140 is put into (a recessed region of) the concave portion 200C from a right side relative to the concave portion 200C (i.e., from upstream relative to the concave portion 200 C in the conveyance direction). Further, the first urging member 140 is disposed between the first outer circumferential surface 210A and the second outer circumferential surface 220A in the front-to-rear direction. As shown in FIG. 5, in a view in the front-to-rear direction, an upper left portion of the first urging member 140 overlaps the first outer circumferential surface 210A and the second outer circumferential surface 220A.

As shown in FIGS. 4 and 9, there is an actuator 47 disposed on a side of a front end portion of the rotational shaft 250. The actuator 47 is configured to swing in response to contacting a leading end of a sheet passing near the feed roller unit 200, and thereby block or open an optical path of a photo-interrupter (not shown). In the first illustrative embodiment, the rotational shaft 250 extends in the front-to-rear direction, long enough to hold the first feed roller 210 and the second feed roller 220. Therefore, the actuator 47 is disposed in the following manner.

As shown in FIG. 9, the actuator 47 is supported to be swingable around a swing axis X47, in the feed-roller accommodating section 93R. The swing axis X47 is positioned on a lower front side relative to a front end portion of the rotational shaft 250. The swing axis X47 extends in the front-to-rear direction. The actuator 47 extends leftward from the swing axis X47, then passes under the front end portion of the rotational shaft 250, and thereafter bends upward. As shown in FIGS. 4 and 9, a tip end portion of the actuator 47 protrudes upward from the guide surface 93A. When a sheet passes near the feed roller unit 200, the tip end portion of the actuator 47 is brought into contact with the sheet and pressed down. Thereby, the actuator 47 swings counterclockwise around the swing axis X47 in a front view shown in FIG. 9. Thus, it is possible to achieve reduction of a space occupied by the actuator 47 inside the opening-closing member 9.

As shown in FIG. 3, the reading sensor 3T included in the reading unit 3 is disposed in a position downstream relative to the feed roller unit 200 and the driving feed rollers 43 in the conveyance direction, along the substantially-horizontal upper portion of the conveyance path P1. The reading sensor 3T is accommodated in a reading-sensor accommodating section 93T. The reading-sensor accommodating section 93T is formed on a left side relative to the feed-roller accommodating section 93R of the chute member 93. The reading sensor 3T is configured to face, from beneath, a sheet being conveyed downstream in the conveyance direction by the feed roller unit 200 and the driving feed rollers 43.

The conveyor 4 includes a large-diameter conveyance roller 44A and a curved guide surface 44G at the downward U-turning portion of the conveyance path P1. An outer circumferential surface of the conveyance roller 44A forms an inner guide surface of the downward U-turning portion of the conveyance path P1. The curved guide surface 44G is disposed a predetermined distance apart from the conveyance roller 44A. The curved guide surface 44G forms an outer guide surface of the downward U-turning portion of the conveyance path P1. The conveyance roller 44A is configured to convey one or more sheets to the reading surface 82A in cooperation with pinch rollers 44P and 44Q.

The conveyor 4 includes a pressing member 49 in a position to face the reading surface 82A from above. The pressing member 49 is configured to press, from above, a sheet being conveyed by the conveyance roller 44A and bring the sheet into contact with the reading surface 82A.

The conveyor 4 includes a discharge roller 48 and a pinch roller 48P disposed in respective positions along the obliquely-ascending portion of the conveyance path P1, on a right side relative to the pressing member 49. The discharge roller 48 and the pinch roller 48P face the discharge tray 92. The discharge roller 48 and the pinch roller 48P are configured to discharge onto the discharge tray 92 a sheet having passed over the reading surface 82A.

In the image reader 1, when the reading unit 3 reads an image of a document supported on the document supporting surface 81A, the scanning mechanism (not shown) of the reading unit 3 operates and moves the reading sensor 3S along the left-to-right direction between a position under a left end portion of the document supporting surface 81A and a position under a right end portion of the document supporting surface 81A. Thereby, the reading sensor 3S reads the image of the document supported on the document supporting surface 81A. Thereafter, the scanning mechanism (not shown) moves the reading sensor 3S, which has completed the image reading operation, back to an original position at a left end portion from a right end portion inside the reading unit 3.

Further, in the image reader 1, when the reading unit 3 reads images of sheets placed on the supply tray 91, the scanning mechanism (not shown) of the reading unit 3 operates and stops the reading sensor 3S in a fixed reading position under the reading surface 82A. Then, when the conveyor 4 sequentially conveys the sheets on the supply tray 91 along the conveyance path P1, the sheets pass over the reading sensor 3S staying in the predetermined reading position while contacting the reading surface 82A. Thereby, the reading sensor 3S reads the images of the sheets passing over the reading sensor 3S. When the reading unit 3 reads images of both sides of each sheet, the reading sensor 3T, which is disposed in a position along the conveyance path P1 between the feed roller unit 200 (the driving feed rollers 43) and the conveyance roller 44A inside the opening-closing member 9, reads an image of a side opposite to a side to be read by the reading sensor 3S. The sheets of which the images have been read are discharged onto the discharge tray 92 by the discharge roller 48 and the pinch roller 48P.

<Operations and Advantageous Effects>

As shown in FIGS. 4 and 5, in the image reader 1 of the first illustrative embodiment, the concave portion 200C is formed by the outer circumferential surface 250A of the rotational shaft 250, the first end surface 211 of the first feed roller 210, and the second end surface 222 of the second feed roller 220. Further, the first urging member 140 is disposed close to the concave portion 200C, so as to be put into the concave portion 200C in the left-to-right direction. Particularly, in the image reader 1, in a front view as shown in FIG. 5, an upper left portion of the first urging member 140 overlaps the first outer circumferential surface 210A and the second circumferential surface 220A. Therefore, it is possible to certainly put the first urging member 140 close to the concave portion 200C in the left-to-right direction.

Further, the first urging member 140 is disposed between the first outer circumferential surface 210A of the first feed roller 210 and the second outer circumferential surface 220A of the second feed roller 220. Therefore, the first urging member 140 does not contact the first outer circumferential surface 210A and the second outer circumferential surface 220A or encumber sheet feeding by the first feed roller 210 and the second feed roller 220.

Accordingly, according to the first illustrative embodiment, it is possible to achieve miniaturization of the image reader 1 in the conveyance direction.

Further, according to the image reader 1, it is possible to easily assemble the feed roller unit 200 having the concave portion 200 by putting the simple rotational shaft 250, the first feed roller 210, and the second feed roller 220 together.

Further, in the image reader 1, as shown in FIG. 5, the supporter 120 is swingable around the swing axis X120 that is positioned on a right side (i.e., upstream in the conveyance direction) relative to the separation roller 42. Further, the upper end portion 141 of the first urging member 140 is connected with the spring receiver 124 of the supporter 120 that is positioned on a left side (i.e., downstream in the conveyance direction) relative to the separation pad 100. Namely, the spring receiver 124 (as a point of effort) is disposed farther away from the swing axis X120 (as a fulcrum point) than a nip position (as a point of load) between the separation roller 42 and the separation pad 100. Thus, by the principle of leverage, it is possible to adequately urge the separation pad 100 against the separation roller 42, even though the urging force of the first urging member 1 is made smaller.

Further, in the image reader 1, as shown in FIG. 5, the lower end portion 142 of the first urging member 140 directly contacts the reinforcing member 95. As shown in FIG. 8, the lower end section 242 of each second urging member 240 directly contacts the reinforcing member 95. Therefore, according to the image reader 1, it is possible to cause the reinforcing member 95 to certainly receive a reaction force generated when the first urging member 140 urges the separation pad 100. Further, it is possible to cause the reinforcing member 95 to certainly receive a reaction force generated when each second urging member 240 urges the feed roller unit 200. Therefore, according to the image reader 1, it is possible to more surely prevent deformation of the chute member 93 than when the lower end portion 142 of the first urging member 140 and the lower end section 242 of each second urging member 240 are in direct contact with the chute member 93. Moreover, it is possible to more effectively achieve thinning of the image reader 1 in the vertical direction substantially perpendicular to the guide surface 93A, than when the lower end portion 142 and the lower end sections 242 directly contacts the chute member 93, and the reinforcing member 95 reinforces the chute member 93.

Further, in the image reader 1, sheets separated on a sheet-by-sheet basis by the separation roller 42 and the separation pad 100 are securely conveyed by the feed roller unit 200, to the reading sensors 3S and 3T of the reading unit 3. Therefore, it is possible to provide a stably high level of image quality of images read by the reading unit 3.

(Second Embodiment)

Figure 10:
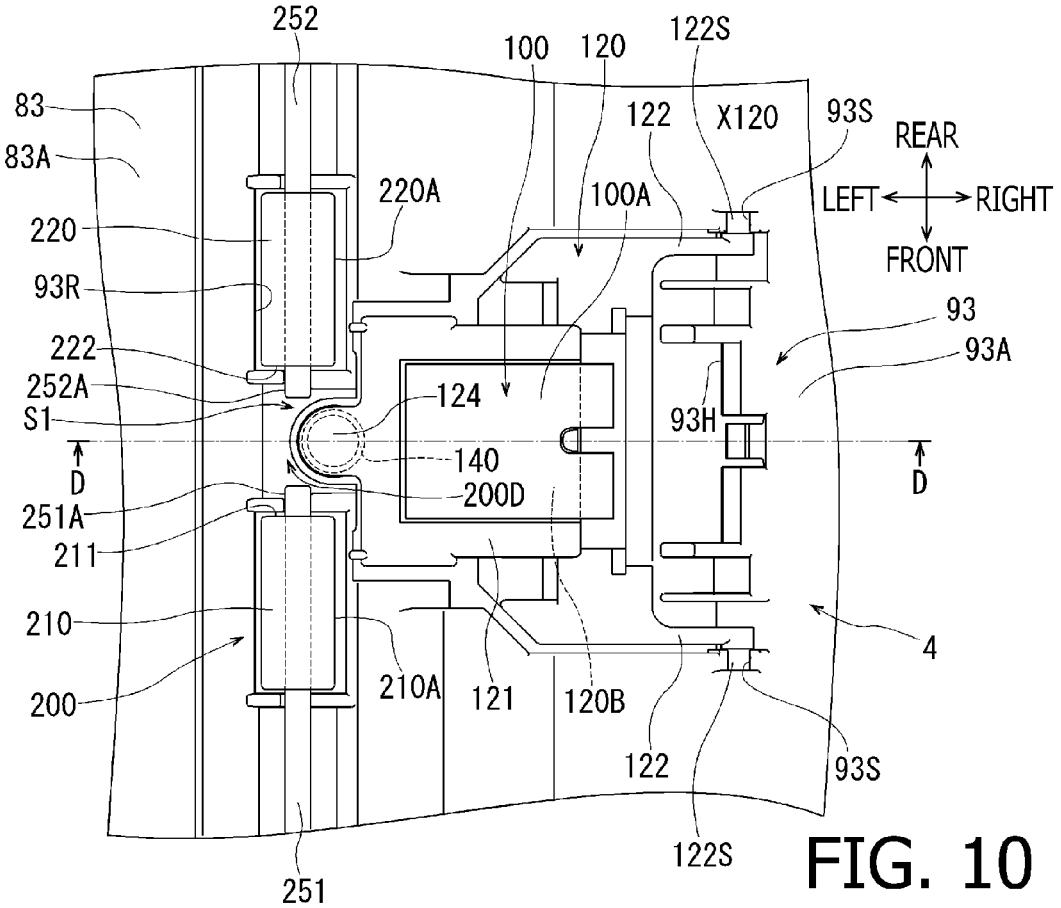
FIG. 10 is a plane view showing a chute member, a separation pad, a first urging member, and a feed roller unit of an image reader in a second illustrative embodiment according to one or more aspects of the present disclosure.
Figure 11:
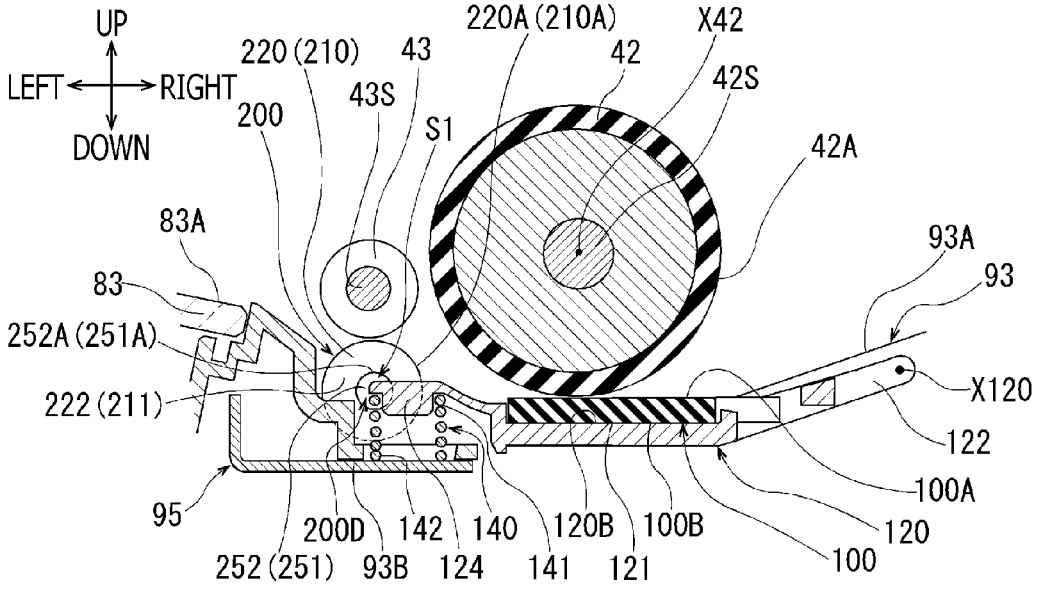
FIG. 11 is a cross-sectional front view taken along a D-D line shown in FIG. 10, in the second illustrative embodiment according to one or more aspects of the present disclosure.

As shown in FIGS. 10 and 11, in an image reader of a second illustrative embodiment, a first rotational shaft 251 and a second rotational shaft 252 are used instead of the rotational shaft 250 of the first illustrative embodiment. Further, according to the second illustrative embodiment, a concave portion 200D is used instead of the concave portion 200C of the first illustrative embodiment. Other elements of the second illustrative embodiment are configured in the same manner as those of the first illustrative embodiment. Therefore, the same elements between the embodiments will be provided with the same reference characters, and detailed explanations about the same elements will be omitted.

As shown in FIG. 10, the first rotational shaft 251 and the second rotational shaft 252 are formed in such a manner that the rotational shaft 250 of the first illustrative embodiment is divided into the two shafts 251 and 252, between the first feed roller 210 and the second feed roller 220. There is a gap 51 formed between the first rotational shaft 251 and the second rotational shaft 252.

The concave portion 200D contains the gap 51. More specifically, the concave portion 200D is formed by the first end surface 211 of the first feed roller 210, the second end surface 222 of the second feed roller 220, an outer circumferential surface 251A of the rotational shaft 251 between the first feed roller 210 and the second feed roller 220, an outer circumferential surface 252A of the rotational shaft 252 between the first feed roller 210 and the second feed roller 220, and the gap 51.

In a front view as shown in FIG. 11, an upper left portion of the first urging member 140 overlaps the first rotational shaft 251 and the second rotational shaft 252.

According to the image reader configured as above in the second illustrative embodiment, it is possible to place the first urging member 140 closer to the feed roller unit 200 in the left-to-right direction. Thus, it is possible to achieve further miniaturization of the image reader in the conveyance direction.

Hereinabove, the illustrative embodiments according to aspects of the present disclosure have been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only exemplary illustrative embodiments of the present disclosure and but a few examples of their versatility are shown and described in the present disclosure. It is to be understood that the present disclosure is capable of use in various other combinations and environments and is capable of changes or modifications within the scope of the inventive concept as expressed herein. For instance, according to aspects of the present disclosure, the following modifications are possible.

(Modifications)

In the aforementioned first illustrative embodiment, the first feed roller 210 and the second feed roller 220 of the feed roller unit 200 are driven to rotate in accordance with rotation of the driving feed rollers 43. Nevertheless, the first feed roller 210 and the second feed roller 220 may be driving rollers.

In the aforementioned first illustrative embodiment, the rotational shaft 250 is not configured to rotate, but the first feed roller 210 and the second feed roller 220 are rotatable around the rotational shaft 250. Nevertheless, the first feed roller 210 and the second feed roller 220 may be fixedly attached to the rotational shaft 250, and may be configured to rotate integrally with the rotational shaft 250.

What is claimed is:

1. A sheet conveyor comprising:

a separation roller configured to convey one or more sheets downstream in a first direction;

a separation pad disposed to face the separation roller, the separation pad being configured to separate the one or more sheets on a sheet-by-sheet basis in cooperation with the separation roller;

a supporter configured to support the separation pad, the supporter being swingable around a swing axis, the swing axis being positioned upstream of the separation roller in the first direction, the swing axis extending in a second direction perpendicular to the first direction;

a first urging member configured to urge the separation pad against the separation roller by urging the supporter in a direction toward the separation roller; and a feed roller disposed downstream of the separation roller in the first direction, the feed roller being configured to convey the one or more sheets separated by the separation roller and the separation pad, downstream in the first direction, the feed roller comprising:

a first outer circumferential surface having a first radius around a rotational axis of the feed roller, the rotational axis extending in the second direction;

a second outer circumferential surface having a second radius around the rotational axis of the feed roller, the second radius being identical to the first radius, the second outer circumferential surface being spaced apart from the first outer circumferential surface in the second direction; and a recessed portion disposed between the first outer circumferential surface and the second outer circumferential surface in the second direction, the recessed portion being recessed inward in a radial direction of the feed roller relative to each of the first outer circumferential surface and the second outer circumferential surface, wherein the first urging member is disposed upstream of the recessed portion in the first direction and disposed between the first outer circumferential surface and the second outer circumferential surface in the second direction, the first urging member being configured to urge the supporter in such a position as not to overlap the separation pad when viewed in a third direction, the third direction being perpendicular to each of the first direction and the second direction.

2. The sheet conveyor according to claim 1, wherein the supporter comprises a receiver disposed at a downstream end portion of the supporter in the first direction, the receiver being configured to receive an end portion of the first urging member, and wherein the first urging member is configured to urge the receiver in a direction approaching the separation roller.

3. The sheet conveyor according to claim 2, wherein the receiver comprises a protrusion protruding toward the recessed portion from the downstream end portion of the supporter in the first direction.

4. The sheet conveyor according to claim 2, wherein the receiver is disposed to overlap the first outer circumferential surface and the second outer circumferential surface when viewed in the second direction.

5. The sheet conveyor according to claim 2, wherein a distance between the swing axis of the supporter and a rotational axis of the separation roller is longer than a distance between a downstream end of the receiver in the first direction and the rotational axis of the separation roller.

6. The sheet conveyor according to claim 2,

Wherein the receiver has a first surface facing the separation roller in the third direction, and wherein the separation pad has a second surface facing the separation roller in the third direction, the first surface being closer to a rotational axis of the separation roller in the third direction than the second surface.

7. The sheet conveyor according to claim 1, wherein the feed roller comprises:

a rotational shaft extending in the second direction;

a first feed roller supported by the rotational shaft; and a second feed roller supported by the rotational shaft, the second feed roller being spaced apart from the first feed roller in the second direction, the second roller having a diameter identical to a diameter of the first roller, wherein an outer circumferential surface of the first feed roller comprises the first outer circumferential surface, wherein an outer circumferential surface of the second feed roller comprises the second outer circumferential surface, wherein the recessed portion is defined by:

an outer circumferential surface of the rotational shaft that is positioned between the first feed roller and the second feed roller;

a first end surface of the first feed roller in the second direction, the first end surface facing the second feed roller in the second direction; and a second end surface of the second feed roller in the second direction, the second end surface facing the first feed roller in the second direction.

8. The sheet conveyor according to claim 7, wherein the rotational shaft comprises:

a first rotational shaft supporting the first feed roller; and a second rotational shaft supporting the second feed roller, the second rotational shaft being spaced apart from the first rotational shaft in the second direction, wherein the recessed portion includes a gap defined between the first rotational shaft and the second rotational shaft in the second direction, and wherein the supporter comprises a receiver disposed at a downstream end portion of the supporter in the first direction, the receiver being configured to receive an end portion of the first urging member, and at least a part of the receiver is disposed to overlap the first rotational shaft and the second rotational shaft when viewed in the second direction.

9. The sheet conveyor according to claim 1, further comprising:

a chute member configured to rotatably support the feed roller, the chute member comprising a guide surface configured to guide the one or more sheets to be conveyed by the feed roller; and a reinforcing member disposed adjacent to a surface of the chute member that is opposite to the guide surface, the reinforcing member being configured to reinforce the chute member, wherein the first urging member has:

a first end portion configured to contact and urge the supporter in a first urging direction; and a second end portion opposite to the first end portion in the first urging direction, the second end portion being in contact with the reinforcing member.

10. The sheet conveyor according to claim 9, further comprising a second urging member configured to urge the feed roller toward the one or more sheets separated by the separation roller and the separation pad, wherein the second urging member has:

a third end portion configured to contact and urge the feed roller in a second urging direction; and a fourth end portion opposite to the third end portion in the second urging direction, the fourth end portion being in contact with the reinforcing member.

11. The sheet conveyor according to claim 1, further comprising an image reader disposed downstream of the feed roller in the first direction, the image reader being configured to read images of the one or more sheets conveyed by the feed roller.

12. A sheet conveyor comprising:

a separation roller configured to convey one or more sheets downstream in a first direction;

a separation pad disposed to face the separation roller, the separation pad being configured to separate the one or more sheets on a sheet-by-sheet basis in cooperation with the separation roller;

a supporter configured to support the separation pad, the supporter being swingable around a swing axis, the swing axis being positioned upstream of the separation roller in the first direction, the swing axis extending in a second direction perpendicular to the first direction;

an urging member configured to urge the separation pad against the separation roller by urging the supporter in a direction toward the separation roller; and a feed roller disposed downstream of the separation roller in the first direction, the feed roller being configured to convey the one or more sheets separated by the separation roller and the separation pad, downstream in the first direction, the feed roller comprising:

a first outer circumferential surface having a first radius around a rotational axis extending in the second direction;

a second outer circumferential surface having a second radius around the rotational axis, the second radius being identical to the first radius, the second outer circumferential surface being spaced apart from the first outer circumferential surface in the second direction; and a recessed portion disposed between the first outer circumferential surface and the second outer circumferential surface in the second direction, the recessed portion comprising a third outer circumferential surface having a third radius around the rotational axis, the third radius being smaller than the first radius and the second radius, wherein the urging member is disposed upstream of the concave portion in the first direction and disposed between the first outer circumferential surface and the second outer circumferential surface in the second direction, the urging member being configured to urge the supporter in such a position as not to overlap the separation pad when viewed in a third direction, the third direction being perpendicular to each of the first direction and the second direction.

* * * * *